US009797389B2

(12) United States Patent
Yamashita et al.

(10) Patent No.: US 9,797,389 B2
(45) Date of Patent: Oct. 24, 2017

(54) SWASH PLATE TYPE VARIABLE DISPLACEMENT COMPRESSOR

(71) Applicant: KABUSHIKI KAISHA TOYOTA JIDOSHOKKI, Aichi-ken (JP)

(72) Inventors: Hideharu Yamashita, Kariya (JP); Shinya Yamamoto, Kariya (JP); Takahiro Suzuki, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 238 days.

(21) Appl. No.: 14/748,706

(22) Filed: Jun. 24, 2015

(65) Prior Publication Data

US 2016/0003227 A1 Jan. 7, 2016

(30) Foreign Application Priority Data

Jul. 1, 2014 (JP) ..... 2014-136203

(51) Int. Cl.

*F04B 27/18* (2006.01)
*F04B 27/08* (2006.01)
*F04B 27/10* (2006.01)

(52) U.S. Cl.

CPC ..... *F04B 27/18* (2013.01); *F04B 27/0878* (2013.01); *F04B 27/1045* (2013.01); (Continued)

(58) Field of Classification Search

CPC .. F04B 27/10; F04B 27/1054; F04B 27/1063; F04B 27/1072; F04B 27/16; F04B 27/18; (Continued)

(56) References Cited

U.S. PATENT DOCUMENTS 3,062,020 A * 11/1962 Heidorn ..... F04B 27/109 184/6.17
4,037,993 A 7/1977 Roberts
(Continued)

FOREIGN PATENT DOCUMENTS

| | | |
|---|---|---|
| CN | 1174938 | 3/1998 |
| CN | 103807136 | 5/2014 |
| JP | 5-172052 | 7/1993 |

OTHER PUBLICATIONS

Official Action, along with English-language translation thereof, in CN Appl. No. 201510368530.6 dated Jan. 16, 2017.

*Primary Examiner* — Bryan Lettman
(74) *Attorney, Agent, or Firm* — Greenblum & Bernstein, P.L.C.

(57) ABSTRACT

A swash plate type variable displacement compressor includes a housing having therein a suction chamber, a discharge chamber, a swash plate chamber and a cylinder bore. The compressor further includes a drive shaft and a swash plate that is mounted on the drive shaft for rotation therewith. The compressor further includes a link mechanism, a piston, a conversion mechanism, an actuator and a control mechanism. The actuator includes a partitioning body, a moving body and a pressure control chamber formed between the partitioning body and the moving body into which a refrigerant is introduced from the discharge chamber for moving the moving body. A connecting member and a connecting unit are disposed on radially opposite side of the drive shaft. The compressor further has an urging member that urges the moving body that reduces the inclination angle of the swash plate.

6 Claims, 7 Drawing Sheets

(52) U.S. Cl.
CPC ..... *F04B 27/1063* (2013.01); *F04B 27/1072* (2013.01); *F04B 27/1081* (2013.01); *F04B 2027/1809* (2013.01); *F04B 2027/1813* (2013.01)

(58) Field of Classification Search
CPC .... F04B 27/1804; F04B 27/1809; F04B 1/14; F04B 1/141; F04B 1/146; F04B 1/148; F04B 1/28; F04B 1/29; F04B 1/295
See application file for complete search history.

(56) References Cited

U.S. PATENT DOCUMENTS

| | | | | | |
|---|---|---|---|---|---|
| 4,061,443 | A * | 12/1977 | Black | F04B 27/1072 | 184/6.17 |
| 4,963,074 | A * | 10/1990 | Sanuki | F04B 27/18 | 417/222.1 |
| 5,259,736 | A * | 11/1993 | Terauchi | F01B 3/106 | 417/222.1 |
| 5,842,834 | A * | 12/1998 | Kawaguchi | F04B 27/1036 | 417/222.2 |
| 5,842,835 | A | 12/1998 | Kawaguchi et al. | | |
| 6,146,107 | A * | 11/2000 | Kawaguchi | F04B 27/1072 | 417/222.1 |
| 9,309,874 | B2 | 4/2016 | Yamamoto et al. | | |
| 2002/0073722 | A1 * | 6/2002 | Ota | B60H 1/3208 | 62/228.5 |

* cited by examiner

SWASH PLATE TYPE VARIABLE DISPLACEMENT COMPRESSOR

BACKGROUND OF THE INVENTION

The present invention relates to a swash plate type variable displacement compressor.

Japanese Patent Application Publication No. H05-172052 discloses a conventional swash plate type variable displacement compressor (hereinafter simply referred to as compressor). The compressor has a housing that has therein a suction chamber, a discharge chamber, a swash plate chamber, a center bore and a plurality of cylinder bores. The swash plate chamber is in communication with the center bore. A drive shaft is rotatably supported in the housing. The swash plate chamber has therein a swash plate that is mounted on the drive shaft for rotation therewith. A link mechanism is provided between the drive shaft and the swash plate that permits changing of an inclination angle of the swash plate, that is, an angle of the swash plate relative to an imaginary plane extending perpendicularly to the axis of the drive shaft. A piston is reciprocally slidably received in each cylinder bore. Each piston has a pair of shoes that acts as a conversion mechanism, so that the rotation of the swash plate is converted into reciprocating motion of the piston in the cylinder bore with a length of stroke that is determined in accordance with the inclination angle of the swash plate. The compressor further has an actuator that changes the inclination angle of the swash plate and a control mechanism that controls the actuator.

The actuator has a first moving body, a second moving body and a pressure control chamber. The first moving body and the second moving body are slidably mounted on the drive shaft in alignment with each other. The first moving body is disposed in the center bore. A thrust bearing is provided between the first moving body and the second moving body. The swash plate is connected to the second moving body in such a manner that permits the inclination angle of the swash plate to be changed. The pressure control chamber is formed in the center bore by the first moving body. The first moving body and the second moving body are movable by the internal pressure of the pressure control chamber. A coil spring is provided in the pressure control chamber that urges the first moving body in the direction that increases the inclination angle of the swash plate.

In this compressor, the control mechanism allows part of refrigerant in the discharge chamber into the pressure control chamber thereby to increase pressure in the pressure control chamber. The control mechanism introduces a refrigerant into the pressure control chamber. Movement of the first moving body in the center bore in the axial direction of the drive shaft causes the second moving body to move in the same axial direction. Thus, the inclination angle of the swash plate is increased by the movement of the second moving body via the link mechanism. Thus, the discharge volume per rotation of the drive shaft, i.e. the displacement of the compressor, is increased.

When the pressure in the pressure control chamber is decreased by the control mechanism, the first moving body is moved by the reaction force of compressed gas in the direction that decrease the inclination angle of the swash plate against the urging force of the coil spring. The second moving body is also moved in the same direction as the first moving body, thereby reducing the inclination angle of the swash plate via the link mechanism. Thus, the discharge volume per rotation of the drive shaft and hence the displacement of the compressor is reduced.

In the above-descried compressor that changes displacement by the actuator, however, it is desirable that the displacement should be able to be decreased effectively, as well as be increased effectively. For this purpose, an urging member that urges the first and second moving bodies may be employed so as to effectively reduce the displacement of the compressor. If the urging member is small in size, however, the urging force may not be large enough to reduce the displacement effectively. If the urging member is large, on the other hand, it becomes difficult to secure a space that is large enough for installation the urging member in the housing, with the result that the size of the compressor is increased.

The present invention, which is made in light of the problems mentioned above, is directed to offering a swash plate type variable displacement compressor, having an actuator that changes the displacement, that can effectively reduce the displacement while permitting downsizing of the compressor.

SUMMARY OF THE INVENTION

In accordance with an aspect of the present invention, there is provided a swash plate type variable displacement compressor including a housing having therein a suction chamber, a discharge chamber, a swash plate chamber and a plurality of cylinder bores. The compressor further includes a drive shaft that is rotatably supported by the housing and a swash plate that is mounted on the drive shaft for rotation therewith in the swash plate chamber. The compressor further includes a link mechanism, a piston, a conversion mechanism, an actuator and a control mechanism. The link mechanism permits changing of an inclination angle of the swash plate. The conversion mechanism converts the rotation of the swash plate to a reciprocal motion of the piston with a stroke length that is determined in accordance with the inclination angle of the swash plate. The actuator is disposed in the swash plate chamber and controlled by the control mechanism to change the inclination angle. The actuator includes a partitioning body that is mounted on the drive shaft, a moving body that is movable along the axial direction of the drive shaft relative to the partitioning body and a pressure control chamber that is formed between the partitioning body and the moving body. The moving body is moved when refrigerant in the discharge chamber is introduced into the pressure control chamber. The link mechanism has a connecting member. The moving body has a connecting unit and is configured to move the swash plate towards the partitioning body via the connecting unit to increase the inclination angle when pressure in the pressure control chamber is increased. The connecting member and connecting units are disposed on radially opposite side of the drive shaft. A thrust bearing is provided between the housing and the moving body. The compressor further has an urging member that is provided between the thrust bearing and the moving body and urges the moving body in a direction that reduces the inclination angle of the swash plate.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

The following will describe a swash plate type variable displacement compressor according to embodiments of the present invention with reference to the accompanying drawings. The compressor according to the present invention is a double-headed piston swash plate variable displacement compressor (hereinafter simply referred to as compressor). The compressor is mounted on a vehicle and forms a part of a refrigeration circuit of a vehicle air conditioner.

First Embodiment

Figure 1:
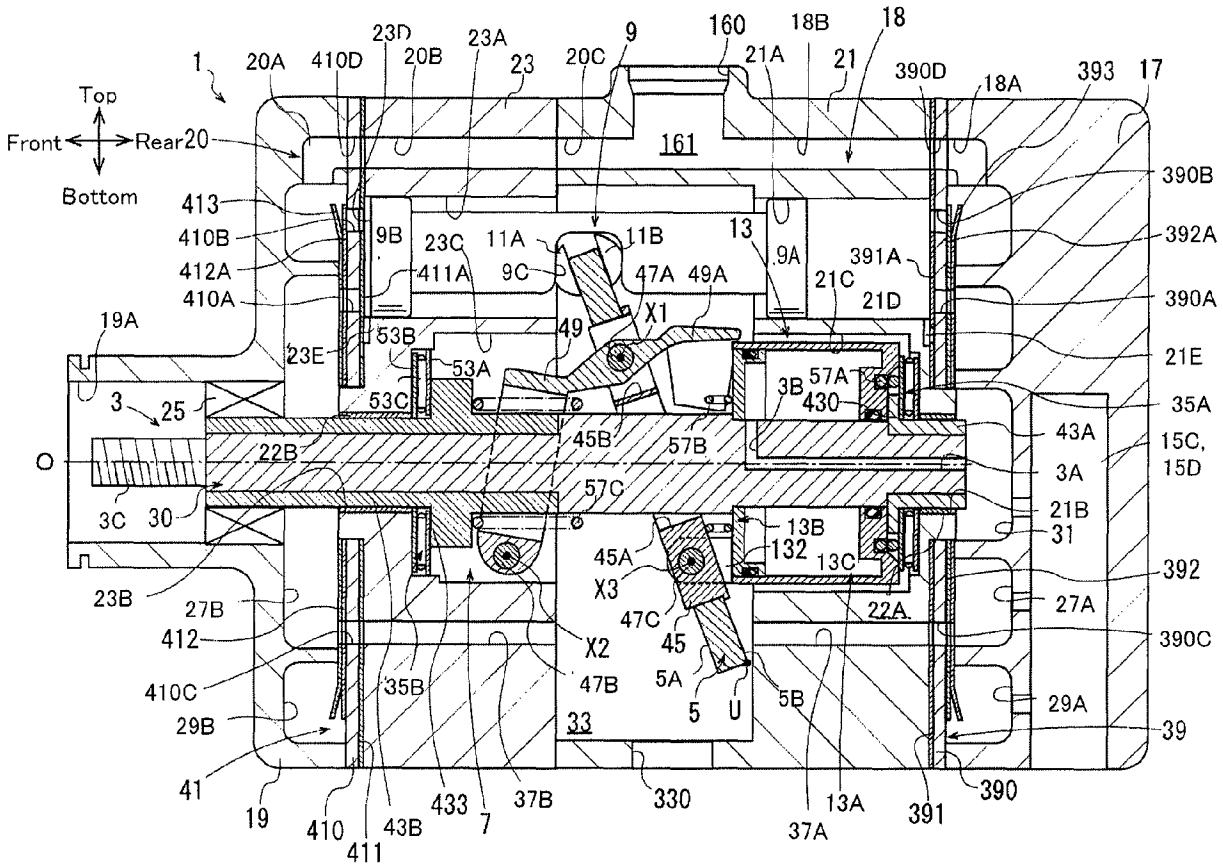
FIG. 1 is a longitudinal cross-sectional view of a compressor according to a first embodiment of the present invention, showing a state of the compressor at its maximum displacement.
Figure 2:
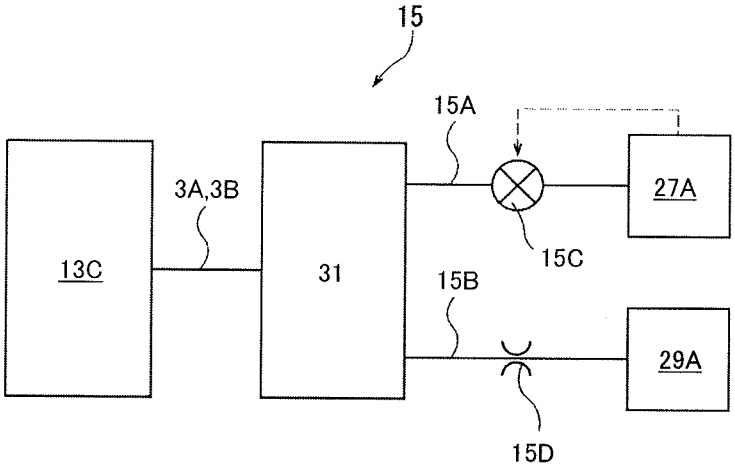
FIG. 2 is a schematic diagram of a control mechanism of the compressor of FIG. 1.

Referring to FIG. 1, the compressor according to a first embodiment includes a housing 1, a drive shaft 3, a swash plate 5, a link mechanism 7, a plurality of pistons 9, a plurality of pairs of shoes 11A, 11B and an actuator 13. As shown in FIG. 2, the compressor further includes a control mechanism 15.

As shown in FIG. 1, the housing 1 includes a pair of first and second cylinder blocks 21, 23, a rear housing 17 that is fixed to the rear end of the first cylinder block 21 with a first valve forming plate 39 held therebetween and a front housing 19 that is fixed to the front end of the second cylinder block 23 with a second valve forming plate 41 held therebetween.

A part of the above-mentioned control mechanism 15 is formed in the rear housing 17. The rear housing 17 has a first suction chamber 27A, a first discharge chamber 29A and a pressure adjusting chamber 31. The pressure adjusting chamber 31 is positioned in the center of the rear housing 17. The first suction chamber 27A has an annular shape and is positioned radially outward of the pressure adjusting chamber 31 in the rear housing 17. The first discharge chamber 29A has an annular shape and is positioned radially outward of the first suction chamber 27A in the rear housing 17.

The rear housing 17 further has therein a first rear passage 18A. The first rear passage 18A is in communication at the rear end thereof with the first discharge chamber 29A and the front end of the first rear passage 18A is opened at the front end of the rear housing 17. The rear end and the front end of the first rear passage 18A correspond to the one end and the other end, respectively, according to the present invention.

The front housing 19 is formed with a boss 19A projecting frontward and having therein a shaft seal device 25. A second suction chamber 27B and a second discharge chamber 29B are formed in the front housing 19. The second suction chamber 27B is positioned on the radially inner side of the front housing 19. The second discharge chamber 29B has an annular shape and is positioned radially outward of the second suction chamber 27B in the front housing 19.

The front housing 19 has therein a first front passage 20A. The first front passage 20A is in communication at the front end thereof with the second discharge chamber 29B and the rear end of the first front passage 20A is opened at the rear end of the front housing 19.

A swash plate chamber 33 is formed between the first cylinder block 21 and the second cylinder block 23 substantially in the center of the housing 1 in longitudinal direction of the compressor.

The first cylinder block 21 has therein a plurality of first cylinder bores 21A which are formed parallel to each other and spaced angularly at a regular interval around the drive shaft 3. A first shaft hole 21B is formed through the first cylinder block 21. A first slide bearing 22A is provided in the first shaft hole 21B and the drive shaft 3 is inserted in the first shaft hole 21B.

A first recess 21C is formed in the first cylinder block 21 in communication and coaxially with the first shaft hole 21B. The first recess 21C corresponds to the recess of the present invention. The first recess 21C is in communication with the swash plate chamber 33 and forms a part of the swash plate chamber 33. The first recess 21C and the pressure adjusting chamber 31 are separated by the first shaft hole 21B.

Figure 3:
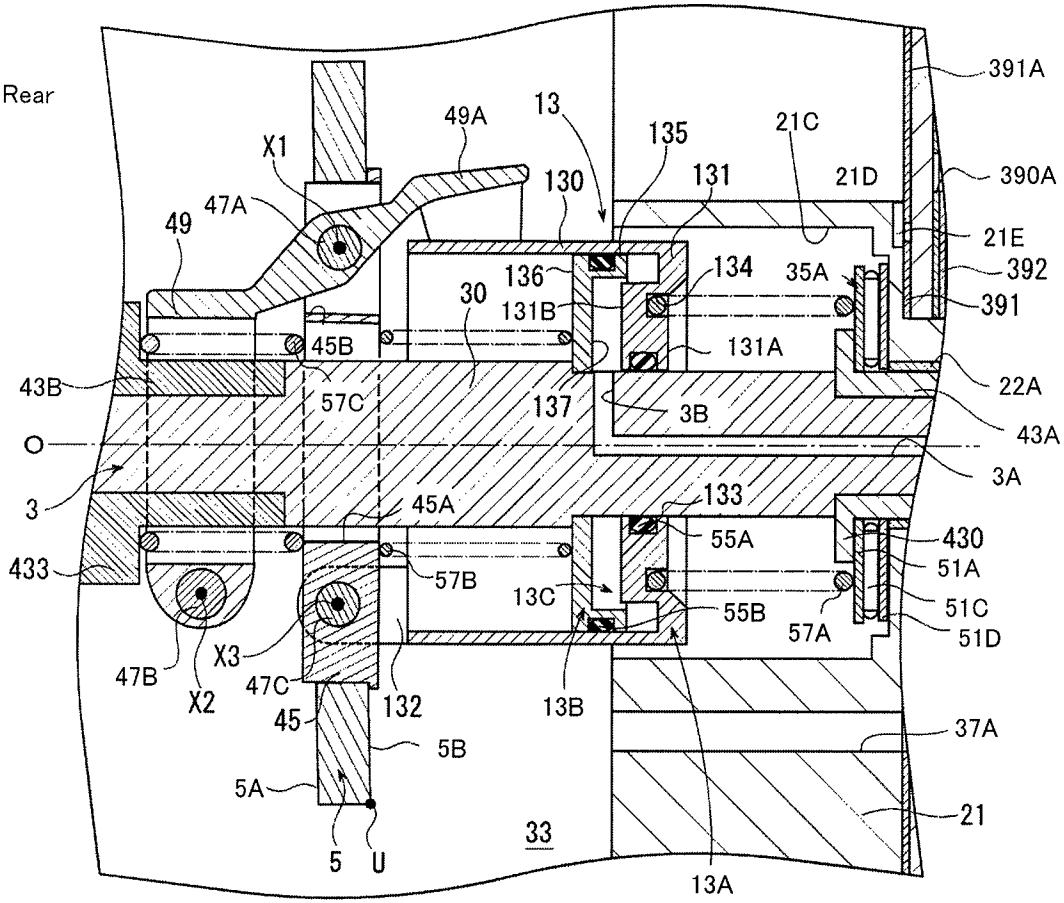
FIG. 3 is a partially enlarged fragmentary view of the compressor of FIG. 1, showing an actuator and a first coil spring.

A first thrust bearing 35A is provided in the first recess 21C at the rear end thereof. The first thrust bearing 35A corresponds to the thrust bearing of the present invention. As shown in FIG. 3, the first thrust bearing 35A includes a first race 51A, a second race 51B, a plurality of rolling members that is provided between the first and second races 51A, 51B and a retainer (not shown). The first thrust bearing 35A is mounted on a first support member 43A that is provided in the rear end of the first recess 21C and forms a part of the drive shaft 3. Thus, the first race 51A of the first thrust bearing 35A is synchronously rotatable with the drive shaft 3 and the second race 51B of the first thrust bearing 35A is held in contact with the first cylinder block 21.

As shown in FIG. 1, the first cylinder block 21 further has therein a first passage 37A that provides a fluid communication between the swash plate chamber 33 and the first suction chamber 27A. A first retainer groove 21E is formed in the first cylinder block 21 to restrict the maximum opening of a first suction reed valve 391A, which will be described later.

The first cylinder block 21 has therein a discharge port 160, a confluence chamber 161, a third front passage 20C, a second rear passage 18B and a suction port 330. The second rear passage 18B is in communication at the front end thereof with the confluence chamber 161 and the rear end of the second rear passage 18B is opened at the rear end of the first cylinder block 21. The confluence chamber 161 is connected through the discharge port 160 to a condenser (not shown) connected in a refrigeration circuit of the air compressor. The front end of the third front passage 20C is opened at the front end of the first cylinder block 21 and the rear end of the third front passage 20C is connected to the confluence chamber 161. The swash plate chamber 33 is connected through the suction port 330 to an evaporator (not shown) that is connected in the refrigeration circuit of the air compressor.

As in the case of the first cylinder block 21, a plurality of second cylinder bores 23A is formed in the second cylinder block 23. Each second cylinder bore 23A forms a pair with its corresponding first cylinder bore 21A in the first cylinder block 21.

The second cylinder block 23 has therein a second shaft hole 23B through which the drive shaft 3 is inserted. The second shaft hole 23B is provided with a second slide bearing 22B. The first slide bearing 22A and the second slide bearing 22B may be replaced by a roller bearing.

A second recess 23C is formed in the second cylinder block 23 in communication and coaxially with the second shaft hole 23B. The second recess 23C is in communication also with the swash plate chamber 33, thus forming a part of the swash plate chamber 33. A second thrust bearing 35B is provided in the second recess 230 at the front end thereof. The above-described first thrust bearing 35A and the second thrust bearing 35B support the thrust force of the drive shaft 3. The second thrust bearing 35B includes a first race 53A, a second race 53B, a plurality of rolling members 53C and a retainer (not shown). The second thrust bearing 35B is mounted on a second support member 43B that supports the drive shaft 3. Thus, the first race 53A of the second thrust bearing 35B is synchronously rotatable with the drive shaft 3 and the second race 51B of the second thrust bearing 35B is held in contact with the second cylinder block 23.

The second cylinder block 23 further has therein a second passage 37B that provides a fluid communication between the swash plate chamber 33 and the second suction chamber 27B. A second retainer groove 23E is formed in the second cylinder block 23 to restrict the opening of a second suction reed valve 411A, which will be described later.

Furthermore, a second front passage 20B is formed in the second cylinder block 23. The front end of the second front passage 20B is opened at the front end of the second cylinder block 23 and the rear end of the second front passage 20B is opened at the rear end of the second cylinder block 23. With the first cylinder block 21 and the second cylinder block 23 joined together, the second front passage 20B is in communication with the third front passage 20C.

The first valve forming plate 39 is provided between the rear housing 17 and the first cylinder block 21. The second valve forming plate 41 is provided between the front housing 19 and the second cylinder block 23.

The first valve forming plate 39 includes a first valve plate 390, a first suction valve plate 391, a first discharge valve plate 392 and a first retainer plate 393. The first valve plate 390, the first discharge valve plate 392 and the first retainer plate 393 have therethrough first suction holes 390A for each of the first cylinder bores 21A. The first valve plate 390 and the first suction valve plate 391 have therethrough first discharge holes 390B for each of the first cylinder bores 21A. In addition, the first valve plate 390, the first suction valve plate 391, the first discharge valve plate 392 and the first retainer plate 393 have therethrough a first suction communication hole 390C. The first valve plate 390 and the first suction valve plate 391 have therethrough a first discharge communication hole 390D.

Each first cylinder bore 21A is communicable with the first suction chamber 27A via the first suction hole 390A and is communicable with the first discharge chamber 29A via the first discharge communication hole 390B. The first suction chamber 27A and the first passage 37A are in communication through the first suction communication hole 390C. The first rear passage 18A and the second rear passage 18B are in communication through the first discharge communication hole 390D.

The first suction valve plate 391 is located on the front side of the first valve plate 390. The first suction valve plate 391 is formed with first suction reed valves 391A for each of the first suction holes 390A to open and close its corresponding first suction holes by elastic deformation. The first discharge valve plate 392 is located on the rear side of the first valve plate 390. The first discharge valve plate 392 is formed with first discharge reed valves 392A for each of the first discharge hole 390B to open and close each its associated first discharge hole 390B by elastic deformation. The first retainer plate 393 is located on the rear side of the first discharge valve plate 392. The first retainer plate 393 restricts the opening of the first discharge reed valve 392A.

The second valve forming plate 41 includes a second valve plate 410, a second suction valve plate 411, a second discharge valve plate 412 and a second retainer plate 413. The second valve plate 410, the second discharge valve plate 412 and the second retainer plate 413 have therethrough second suction holes 410A for each of the second cylinder bores 23A. The second valve plate 410 and the second suction valve plate 411 have therethrough second discharge holes 410B for each of the first cylinder bores 21A. In addition, the second valve plate 410, the second suction valve plate 411, the second discharge valve plate 412 and the second retainer plate 413 have therethrough a second suction communication hole 410C. The second valve plate 410 and the second suction valve plate 411 have therethrough a second discharge communication hole 410D.

Each second cylinder bore 23A is communicable with the second suction chamber 27B via the second suction hole 410A and is also communicable with the second discharge chamber 29B via the second discharge hole 410B. The second suction chamber 27B and the second passage 37B are in communication through the second suction communication hole 410C. The first front passage 20A and the second front passage 20B are in communication through the second discharge communication hole 410D.

The second suction valve plate 411 is located on the rear end of the second valve plate 410. The second suction valve plate 411 is formed with a second suction reed valve 411A for each of the second suction holes 410A to open and close its corresponding second suction hole 410A. The second discharge valve plate 412 is located on the front side of the second valve plate 410. The second discharge valve plate 412 is formed with a second discharge reed valve 412A for each of the second discharge holes 410B. The second retainer plate 413 is located on the front side of the second discharge valve plate 412. The second retainer plate 413 restricts the opening of the second discharge reed valve 412A.

In the compressor, the first rear passage 18A, the first discharge communication hole 390D, and the second rear passage 18B cooperate to form a first discharge passage 18. The first front passage 20A, the second discharge communication hole 410D and the second front passage 20B and the third front passage 20C cooperate to form a second discharge passage 20.

The first and second suction chambers 27A, 27B are in communication with the swash plate chamber 33 via the first and second passages 37A, 37B, respectively, so that the pressures in the first and second suction chambers 27A, 27B are substantially the same as that in the swash plate chamber 33. Since low pressure refrigerant flowed from the evaporator into the swash plate chamber 33 via the suction port 330, the pressures in the first and second suction chambers 27A, 27B and the swash plate chamber 33 are lower than the pressures in first and second discharge chambers 29A, 29B The drive shaft 3 includes a drive shaft body 30, the first support member 43A and the second support member 43B. The drive shaft body 30 extends in the front housing 19, the second cylinder block 23, the first cylinder block 21 and the rear housing 17 is supported rotatably at the opposite ends thereof by the first and second slide bearings 22A, 22B by way of the first and second support members 43A, 43B, respectively. Thus, the drive shaft 3 is supported in the housing 1 rotatably about the axis O of the drive shaft body 30. The front end of the drive shaft 3 extends into the boss 19A and the rear end of the drive shaft 3 extends into the pressure adjusting chamber 31.

The drive shaft body 30 has mounted thereon the swash plate 5, the link mechanism 7 and the actuator 13.

The first support member 43A is press-fitted to the rear end of the drive shaft body 30 and positioned between the drive shaft body 30 and the first slide bearing 22A. The rear end of the first support member 43A extends into the pressure adjusting chamber 31. As shown in FIG. 3, a flange 430 is formed at the front end of the first support member 43A. The flange 430 corresponds to the flange of the present invention. The flange 430 is in contact with the first race 51A of the first thrust bearing 35A in the first recess 21C. Thus, the first thrust bearing 35A is held between the flange 430 and the first cylinder block 21.

As shown in FIG. 1, the second support member 43B is press-fitted to the drive shaft body 30 and positioned between the drive shaft body 30 and the second slide bearing 22B in the second shaft hole 23B. The second support member 43B has a flange 433 that is in contact with the first race 53A of the second thrust bearing 35B in the second recess 23C. Thus, the second thrust bearing 35B is held between the flange 433 and the second cylinder block 23.

The second support member 43B further has therein a mounting portion (not shown) through which a second pin 47B (which will be described later) is inserted.

The swash plate 5 has a shape of a circular disk having a front surface 5A and a rear surface 5B. The front surface 5A faces frontward, whereas the rear surface 5B faces rearward in the swash plate chamber 33.

The swash plate 5 includes a ring plate 45 that has a shape of a circular disk having at the center thereof a hole 45A. The swash plate 5 is mounted on the drive shaft 3 with the drive shaft body 30 inserted through the hole 45A of the ring plate 45 of the swash plate 5. The ring plate 45 further has a link portion (not shown) to which arms 132 (which will be described later) are connected.

The link mechanism 7 includes a lug arm 49 that is disposed frontward of the swash plate 5 in the swash plate chamber 33 and positioned between the swash plate 5 and the second support member 43B. The lug arm 49 has substantially an L-shape and has at the rear end thereof a weight 49A. The weight 49A extends over approximately half the circumference of the actuator 13. The weight 49A may be designed in any suitable shape.

The rear end of the lug arm 49 is connected to one end of the ring plate 45 by a first pin 47A. The first pin 47A corresponds to the connecting member of the present invention. X1 designates a first axis of the first pin 47A, and the lug arm 49 is supported so as to be swingable about the first axis X1 with respect to the one end of the ring plate 45, i.e. one end of the swash plate 5. The first axis X1 extends perpendicularly to the axis O of the drive shaft 3.

The front end of the lug arm 49 is connected to the second support member 43B by a second pin 47B. Thus, the lug arm 49 is supported so as to be swingable about an axis of the second pin 47B, i.e. the second axis X2, with respect to the second support member 43B, i.e. drive shaft 3. The second axis X2 extends parallel to the first axis X1. The lug arm 49, the first and second pins 47A, 47B, and the arms 132 and a third pin (which will be described later) cooperate to form the link mechanism 7 of the present invention.

The weight 49A is provided on the rear end side of the lug arm 49, that is, on the rear side of the first axis X1 that is opposite from the second axis X2. With the lug arm 49 supported by the ring plate 45 at the first pin 47A, the weight 49A is positioned, through a groove 45B of the ring plate 45, rearward of the ring plate 45, i.e. rear surface 5B of the swash plate 5. Thus, the centrifugal force caused by the rotation of the swash plate 5 about the axis O of the drive shaft 3 acts on the weight 49A at the rear surface 5B of the swash plate In the compressor of the present embodiment, the swash plate 5 which is connected to the drive shaft 3 via the link mechanism 7 rotatable with the drive shaft 3. The lug arm 49 is supported rotatably about the first axis X1 and the second axis X2, so that the inclination angle of the swash plate 5 with respect to an imaginary plane extending perpendicularly to the axis O of the drive shaft 3 is changeable. In other words, the link mechanism is provided between the drive shaft 3 and the swash plate 5 and permits changing of the inclination angle of the swash plate 5.

Each piston 9 has at the rear end thereof a first head portion 9A and at the front end thereof a second head portion 9B, respectively. The first head portion 9A is reciprocally movably received in the first cylinder bore 21A. A first compression chamber 21D is defined by the first head portion 9A and the first valve forming plate 39 in each first cylinder bore 21A. The second head portion 9B is reciprocally movably received in the second cylinder bore 23A. A second compression chamber 23D is defined by the second head portion 9B and the second valve forming plate 41 in each second cylinder bore 23A.

Each piston 9 has therein at the center thereof a piston recess 9C and a pair of hemispherical shoes 11A, 11B is disposed. The rotation of the swash plate 5 is converted to the reciprocal motion of the piston 9 by way of the shoes 11A, 11B. The shoes 11A, 11B correspond to the conversion mechanism of the present invention. Thus, the first head portion 9A and the second head portion 9B of the piston 9 are movable in a reciprocating manner in the corresponding first cylinder bore 21A and the second cylinder bore 23A located at one end and the other end of the piston 9, respectively, with a stroke length that is determined in accordance with the inclination angle of the swash plate 5.

Figure 4:
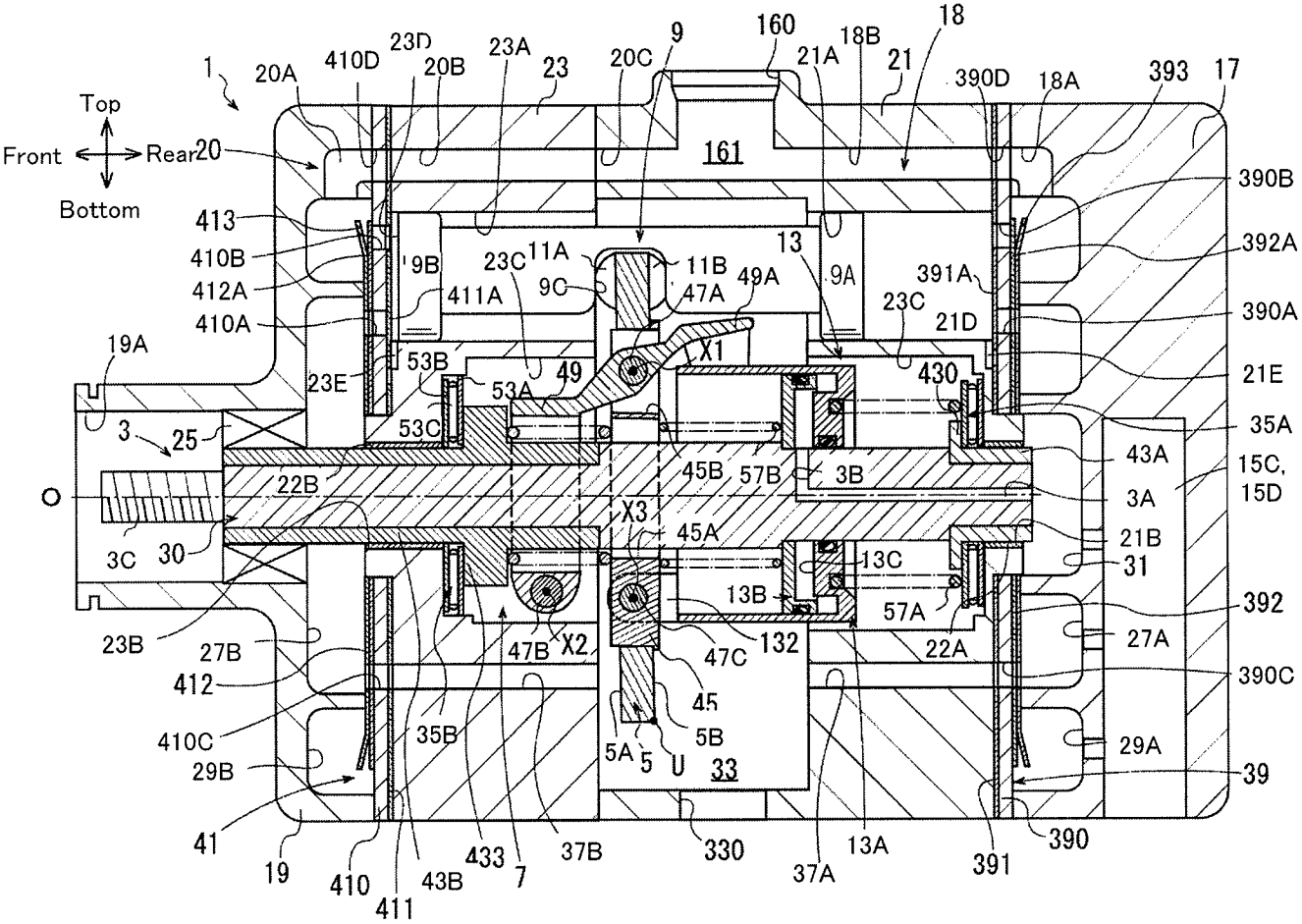
FIG. 4 is a longitudinal cross-sectional view of the compressor FIG. 1, showing a state of the compressor at its minimum displacement.

In this compressor, the top dead center positions of the first head portion 9A and the second head portion 9B are variable with the change of the stroke length that is caused by the change of the inclination angle of the swash plate 5. More specifically, the top dead center of the second head portion 9B moves a longer distance than that of the first head portion 9A as the inclination angle of the swash plate 5 is reduced, as shown in FIG. 4.

The actuator 13 is disposed rearward of the swash plate 5 in the swash plate chamber 33 as shown in FIG. 1 and movable into and out of the first recess 21C. The actuator 13 includes a moving body 13A and a partitioning body 13B, and a pressure control chamber 13C is formed between the moving body 13A and the partitioning body 13B.

As shown in FIG. 3, the moving body 13A includes a peripheral wall 130, a bottom wall 131 and a pair of the aforementioned arms 132 (only one arm being shown in the drawing). The arms 132 correspond to the connecting unit of the present invention.

The peripheral wall 130 extends along the axis O of the drive shaft 3. The bottom wall 131 is formed extending from the peripheral wall 130 toward the drive shaft 3 at the rear end of the peripheral wall 130. The bottom wall 131 has therethrough a hole 133 through which the drive shaft body 30 is inserted. An O-ring 55A is provided in the bottom wall 131 so as to surround the drive shaft body 30. The rear surface 131A of the bottom wall 131 is formed with a recess that receives therein the flange 430 of the first support member 43A when the moving body 13A is moved to its rear most position, as shown in FIG. 1. The rear surface 131A has therein an annular groove 134 recessed in the direction of the axis O of the drive shaft 3 toward the partitioning body 13B. The front surface 131B of the bottom wall 131 is formed projecting toward the moving body 13A.

Each arm 132 is formed extending frontward from the front end of the peripheral wall 130. The moving body 13A has a bottomed cylindrical shape that is formed by the peripheral wall 130 and the bottom wall 131.

The partitioning body 13B has a disk shape having an outer diameter that is substantially the same as the inner diameter of the moving body 13A. The partitioning body 13B has an outer peripheral surface 135, and an O-ring 55B is provided in the outer peripheral surface 135 of the partitioning body 13B. The partitioning body has a recessed rear surface 137 that is complementary to the projecting front surface 131B of the bottom wall 131.

The drive shaft body 30 is inserted through the moving body 13A and the partitioning body 13B. The moving body 13A is disposed in facing relation to the link mechanism 7 across the swash plate 5 and mounted on the drive shaft body 30 so as to be received in the first recess 21C. On the other hand, the partitioning body 13B is disposed rearward of the swash plate 5 in the moving body 13A and surrounded by the peripheral wall 130 of the moving body 13A. Thus, the pressure control chamber 13C is formed between the moving body 13A and the partitioning body 13B. Specifically, the pressure control chamber 13C is defined by the peripheral wall 130 and the bottom wall 131 of the moving body 13A and the partitioning body 13B in the swash plate chamber 33.

The moving body 13A is mounted on the drive shaft body 30 for rotation therewith and slidable in the direction of the axis O of the drive shaft in the swash plate chamber 33. The rear surface 131A of the bottom wall 131 faces the first thrust bearing 35A and the flange 430. The partitioning body 13B is fixed on the drive shaft body 30 for the rotation therewith. That is, unlike the moving body 13A, the partitioning body 13B is rotatable with the drive shaft, but immovable in the direction of the axis O of the drive shaft 3. As the moving body 13A moves in direction of the axis O of the drive shaft 3, the peripheral wall 130 of the moving body 13A slides on the outer peripheral surface 135 of the partitioning body 13B. In other words, the moving body 13A is movable relative to the partitioning body 13B. It is noted that the partitioning body 13B according to the present invention may be mounted on the drive shaft body 30 movably in direction of the axis O of the drive shaft 3.

The arms 132 are connected to the ring plate 45 by a third pin 47C. The third pin 47C corresponds to the connecting unit of the present invention. Thus, the swash plate 5 is supported swingably about the axis X3 of the third pin 47C by the moving body 13A. The axis X3 extends parallel to the first and the second axes X1, X2. In the compressor, the first pin 47A, i.e. the connecting member, and the third pin 47C and the arm 132, i.e. the connecting unit, are disposed on radially opposite sides of the drive shaft body 30.

Three coil springs, namely a first coil spring 57A, a second coil spring 57B and a third coil spring 57C are disposed around the axis O of the drive shaft 3 and extend along axial direction of the drive shaft body 30. The first coil spring 57A is provided between the first thrust bearing 35A and the moving body 13A in the first recess 21C. Specifically, the first coil spring 57A is disposed between the first race 51A of the first thrust bearing 35A and the groove 134 in the bottom wall 131 of the moving body 13A. The first coil spring 57A at the rear end thereof is contactable with the first race 51A and the front end of the first coil spring 57A is contactable with the groove 134. Thus, the first coil spring 57A urges the moving body 13A away from the first thrust bearing 35A. The first coil spring 57A corresponds to the urging member of the present invention.

The second coil spring 57B is provided between the partitioning body 13B and the swash plate 5, more specifically, a front surface 136 of the partitioning body 13B and the rear surface 5B of the ring plate 45. The front end of the second coil spring 57B is contactable with the ring plate 45. Thus, second coil spring 57B urges the swash plate 5 away from the partitioning body 13B. The second coil spring 57B has a smaller diameter and smaller urging force than the first coil spring 57A. The second coil spring 57B corresponds to the supplementary urging member of the present invention.

The third coil spring 57C is provided between the swash plate 5 and the second support member 43B, more specifically, between the front surface 5A of the ring plate 45 of the swash plate 5 and the flange 433 of the second support member 43B. The rear end of the third coil spring 57C is contactable with the ring plate 45 and the front end is contactable with the flange 433. The third coil spring 57C urges the swash plate 5 away from the flange 433 of the second support member 43B.

As shown in FIG. 1, the drive shaft body 30 has therein an in-shaft axial passage 3A that extends frontward from the rear end of the drive shaft body 30 in the direction of the axis O of the drive shaft 3 and an in-shaft radial passage 3B that extends radially from the front end of the in-shaft axial passage 3A and is opened at the outer peripheral surface of the drive shaft body 30. The rear end of the in-shaft axial passage 3A is connected to the pressure adjusting chamber 31. On the other hand, the in-shaft radial passage 3B is connected to the pressure control chamber 13C. Therefore, the pressure control chamber 13C is in communication with the pressure adjusting chamber 31 via the in-shaft radial passage 3B and the in-shaft axial passage 3A.

The drive shaft body 30 has at the front end thereof a threaded portion 3C. The drive shaft 3 is connected to a pulley or an electromagnetic clutch (either not shown) through the threaded portion 3C.

As shown in FIG. 2, the control mechanism 15 includes a low pressure passage 15A, a high pressure passage 15B, a control valve 15C, an orifice 15D, the in-shaft axial passage 3A and the in-shaft radial passage 3B.

The low pressure passage 15A is connected to the pressure adjusting chamber 31 and the first suction chamber 27A. The pressure adjusting chamber 31, the pressure control chamber 13C and the first suction chamber 27A are connected through the low pressure passage 15A, the in-shaft axial passage 3A and the in-shaft radial passage 3B. The high pressure passage 15B is connected to the pressure adjusting chamber 31 and the first discharge chamber 29A. The pressure control chamber 13C, the pressure adjusting chamber 31 and the first discharge chamber 29A are connected through the high pressure passage 15B, the in-shaft axial passage 3A and the in-shaft radial passage 3B. The high pressure passage 15B is provided with the orifice 15D.

The control valve 15C is provided in the low pressure passage 15A. The control valve 15C controls the opening of the low pressure passage 15A according to the pressure in the first suction chamber 27A.

The compressor has a pipe for connection between the evaporator (not shown) and the suction port 330 of the compressor and a pipe for connection between the discharge port 160 of the compressor and the condenser (not shown). The condenser is connected to the evaporator via the pipe and an expansion valve. The compressor, the evaporator, the expansion valve and the condenser cooperate to form a refrigeration cycle of a vehicle air conditioner. The evaporator, the expansion valve, the condenser and the pipes are omitted from the illustration in the drawings.

In the compressor having the above-described configuration, the rotation of the swash plate 5 driven by the drive shaft 3 causes each piston 9 to reciprocate in its corresponding first and second cylinder bores 21A, 21B. The first and the second compression chambers 21D, 23D change the discharge volume according to the piston stroke. In the compressor, suction phase at which the refrigerant is being introduced into the first and second compression chambers 21D, 23D, compression phase at which the refrigeration gas is being compressed in the first and second compression chambers 21D, 23D and discharge phase at which the compressed refrigerant is being discharged into the first and second discharge chambers 29A, 29B are repeatedly taken place.

Refrigerant discharged into the first discharge chamber 29A is flowed through the first discharge passage 18 toward the confluence chamber 161. Similarly, refrigerant discharged into the second discharge chamber 29B is flowed through the second discharge passage 20 toward the confluence chamber 161. The refrigerant in the confluence chamber 161 is then discharged through the discharge port 160 to the condenser.

During the suction phase of a cylinder bore, a compression reaction force, or a reaction force of compressed gas, acts on the rotation member that is formed by the swash plate 5, the ring plate 45, the lug arm 49 and the first pin 47A in the direction that tends to reduce the inclination angle of the swash plate 5. The discharge volume can be controlled by increasing or decreasing the stroke length of the piston 9 that is accomplished by changing the inclination angle of the swash plate 5.

Specifically, in the control mechanism 15 of the compressor, when the control valve 15C shown in FIG. 2 is opened and increase the opening of the low pressure passage, the pressures in the pressure adjusting chamber 31 and the pressure control chamber 13C become substantially the same as the pressure in the first suction chamber 27A. In the compressor, the compression reaction force that is applied to the swash plate 5 and the urging force of the first and the second coil springs 57A, 57B urge the swash plate 5 in the direction that reduces the inclination angle of the swash plate 5. Accordingly, the moving body 13A is pulled or moved frontward by the swash plate 5 that is connected to the moving body 13A via the arms 132 at the axis X3 as the acting axis in the actuator 13, as shown in FIGS. 3, 4.

The swash plate 5 then tilts in such a way that the point U on the swash plate 5 is moved leftward as seen in FIG. 1 about the third axis X3. The lug arm 49 tilts in such a way that the rear end of lug arm 49 swings in counterclockwise direction about the first axis X1 and the front end of the lug arm 49 also swings in counterclockwise direction about the second axis X2 as seen FIG. 1. As a result, the lug arm 49 moves close to the flange 433 of the second support member 43B, as shown in FIG. 3. Accordingly, the swash plate 5 tilts about the first axis X1 with the axis X3 as the point of application. The inclination angle of the swash plate 5 is reduced, so that the stroke length of the piston 9 is reduced, with the result that the inclination angle of the swash plate 5 becomes minimum, as shown in FIG. 4.

In the compressor, the centrifugal force generated by the rotation of the weight 49A is also applied to the swash plate 5, so that the swash plate 5 tends to be easily tilted in the direction that decreases the inclination angle of the swash plate 5.

The ring plate 45 is brought into contact with the rear end of the third coil spring 57C with the reduction in the inclination angle of the swash plate 5. The third coil spring 57C then urges the swash plate 5 in the direction that increases the inclination angle of the swash plate 5.

When the inclination angle of the swash plate 5 is decreased and the stroke length of the piston 9 is decreased, accordingly, the top dead center of the piston 9 is shifted away from the first valve forming plate 39. When the inclination angle of the swash plate 5 is close to zero, slight compression takes place in the second compression chamber 23D whereas no compression takes place in the first compression chamber 21D.

When the opening of the low pressure passage 15A is decreased by the control valve 15C, the pressure in the pressure adjusting chamber 31 is increased by the pressure of refrigerant in the second discharge chamber 29B, thus increasing the pressure in the pressure control chamber 13C. Consequently, the moving body 13A of the actuator 13 is moved rearward, that is, moved toward the first thrust bearing 35A against the piston compression force and the urging force of the first coil spring 57A acting on the swash plate 5. In other words, the actuator 13 is configured in such a way that the moving body 13A is moved when refrigerant in the discharge chamber 29B is introduced into the pressure control chamber 13C.

The swash plate 5 then tilts in such a way that the point U on the swash plate 5 is moved rightward as seen in FIG. 1. This is accomplished by pulling the swash plate 5 rearward by the moving body 13A via the arms 132 against the urging force of the second oil spring 57B. The rear end of the lug arm 49 swings in clockwise direction about the first axis X1 and the front end of the lug arm 49 swings in clockwise direction about the second axis X2 a seen in FIG. 1. The urging force of the third coil spring 57C then acts on the swash plate 5 to assist in the tilting of the swash plate. Thus, the lug arm 49 is moved away from the flange 433 of the second support member 43B. Accordingly, the swash plate 5 tilts about the first axis X1 with the third axis X3 as the point of application in the direction that increases the inclination angle of the swash plate 5. In other words, the moving body is configured to move the swash plate toward the partitioning body via the connecting unit to increase the inclination angle when pressure in the pressure control chamber is increased. Accordingly, the stroke length of the piston 9 is increased and the discharge volume per rotation of the drive shaft 3 and hence the displacement of the compressor is increased, accordingly. The swash plate 5 shown in FIG. 1 is at the maximum inclination angle.

In the compressor, the drive shaft body 30 is inserted through the swash plate 5 and the inclination angle of the swash plate 5 is changeable by the actuator 13 and the link mechanism 7. The first coil spring 57A is disposed between the first race 51A of the first thrust bearing 35A and the groove 134 of the bottom wall 131, and the urging force of the first coil spring 57A acts on the swash plate 5 via the arms 132 of the moving body 13A and the third pin 47C in the direction that reduces the inclination angle of the swash plate 5.

The urging force of the second coil spring 57B that is mounted between the front surface 136 of the partitioning body 13B and the ring plate 45 acts on the swash plate 5. As with the first coil spring 57A, the second coil spring 57B urges the swash plate 5 in the direction that reduces the inclination angle of the swash plate 5.

The first pin 47A, the arms 132 and the third pin 47C are disposed on opposite sides across the axis O of the drive shaft 3. Thus, the urging force of the first coil spring 57A acts on the swash plate 5 through the moving body 13A and the arms 132 at the third pin 47C that is offset from the axis O of the drive shaft 3, or the center of the rotation of the swash plate 5. The second coil spring 57B that is in contact with the ring plate 45 provides an urging force that acts on the swash plate 5 substantially at the center of the rotation thereof. In other words, the urging force of the first coil spring 57A acts on the swash plate 5 at a position that is spaced further from the first pin 47A than the urging force of the second coil spring 57B.

Figure 5:
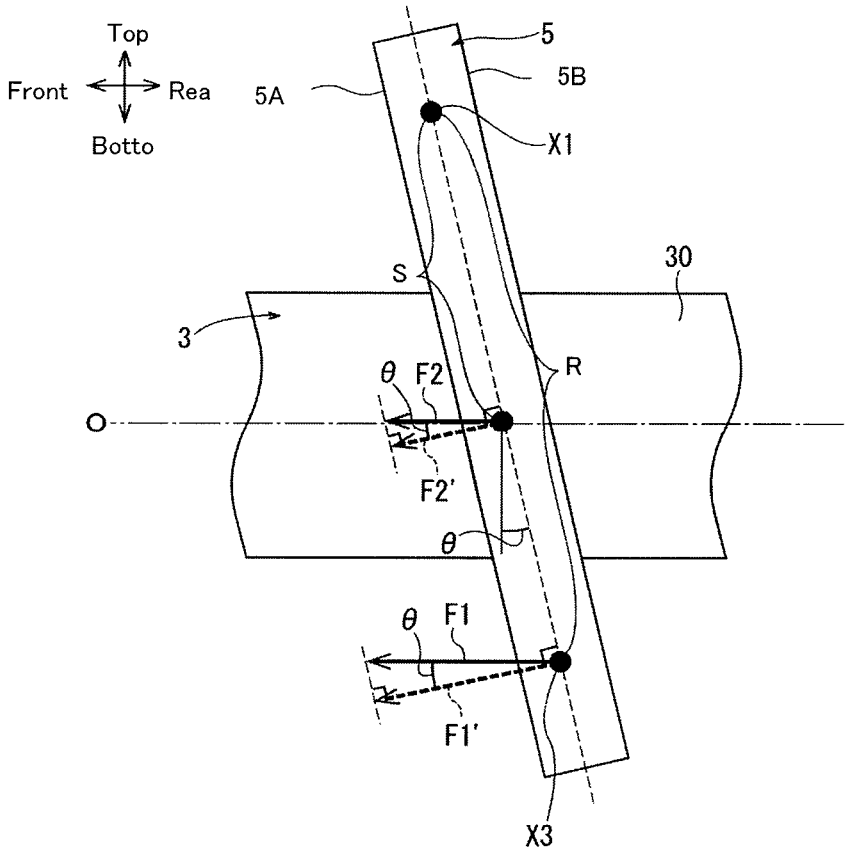
FIG. 5 is a schematic diagram showing urging forces acting on a swash plate of the compressor of FIG. 1.

The following will describe the operation of the compressor of the present embodiment with reference to FIG. 5. In FIG. 5, the inclination angle of the swash plate 5 is indicated by θ and the urging forces of the first and second coil springs 57A and 57B by F1 and F2, respectively. The inclination angle θ is an angle that is larger than the minimum inclination angle shown in FIG. 4 and smaller than the maximum inclination angle shown in FIG. 1.

As described above, the urging force of the first coil spring 57A acts on the swash plate 5 via the arms 132 of the moving body 13A and the third pin 47C. Specifically, the urging force F1 acts on the swash plate 5 at the other end U thereof frontward at third axis X3. In the swash plate 5 that is tilted at the angle θ and is swingable about the first axis X1, a component force F1' of the urging force F1 acts on the swash plate 5 at the third axis X3 that is separated from the first axis X1 by a distance R. Thus, a moment M1 that is expressed by F1'×R acts on the swash plate 5 in the direction that reduces the inclination angle of the swash plate 5.

Because the swash plate 5 is also urged by the second coil spring 57B, a component force F2' of the urging force F2 acts on the swash plate 5 at the axis O of the drive shaft 3 that is separated away from the first axis X1 by a distance S. Accordingly, in addition to the above-described M1, a moment M2 that is expressed by F2'×S acts on the swash plate 5. That is, the swash plate 5 at the inclination angle θ receives the moments M1, M2 acting in the direction that reduces the inclination angle of the swash plate 5. In the compressor of the present embodiment, therefore, the inclination angle is easily reduced from the position of the angle θ.

The compressor is so configured that the arms 132 and the third pin 47C are disposed on the side of the axis O of the drive shaft 3 that is opposite from the first pin 47A, so that the distance R is larger than the distance S. The moment M2 is greater than the moment M1 and the difference therebetween is greater than the difference between the urging forces F1 and F2. For example, even when the urging force F1 and the urging force F2 are substantially the same, M1 may be larger than M2. The moment M1 that acts on the swash plate 5 may be large even if the urging force F1 is small. Thus, the swash plate 5 is urged appropriately in the direction to reduce the inclination angle of the swash plate 5 while restricting the enlargement in size of the first coil spring 57A.

As described in the above, in addition to the first coil spring 57A, the second coil spring 57B urges the swash plate 5 in the direction to reduce the inclination angle of the swash plate 5, which also helps to restrict the enlargement of the first coil spring 57A.

Therefore, the compressor of the present embodiment that changes the compressor displacement by using the actuator 13 allows to reduce the displacement appropriately and to downsize the compressor.

Additionally, the provision of the third coil spring 57C that urges the swash plate 5 in the direction that increases the inclination angle of the swash plate helps to increase the displacement of the compressor appropriately.

In the compressor in which the first coil spring 57A is positioned between the first race 51A of the first thrust bearing 35A the groove 134 of the bottom wall 131 of the moving body 13A and the moving body 13A is movable in the direction of the axis O of the drive shaft 3, a space for mounting of the first coil spring 57A may be easily secured in the first recess 21C.

The moving body 13A is connected to the swash plate 5 via the arms 132 and the third pin 47C, so that the moving body 13A is rotatable with the swash plate 5 and hence the drive shaft 3. The first race 51A of the first thrust bearing 35A is synchronously rotatable with the drive shaft 3. Therefore, the mounting of the first coil spring 57A between the first thrust bearing 35A and the moving body 13A, specifically between the first race 51A of the first thrust bearing 35A and the groove 134 of the moving body 13A, may be accomplished easily.

The formation of the groove 134 in the bottom wall 131 of the moving body 13A allows securing a space between the bottom wall 131 and the first race 51A that is larger in the direction of the axis O of the drive shaft 3 by the dimension corresponding to the depth of the groove 134. This permits the use of a coil spring having a larger length for the first coil spring 57A than in the case that no groove such as 134 is formed, while suppressing the increase in the size of the compressor and also securing appropriate force for urging to the swash plate 5.

In the compressor, a plurality of the first cylinder bores 21A and a plurality of the second cylinder bores 23A are formed in the first and second cylinder blocks 21, 23, respectively. The piston 9 has the first head portion 9A that is reciprocally received in the first cylinder bore 21A and the second head portion 9B that is reciprocally received in the second cylinder bore 23A.

In other words, the compressor of the present invention is a double-headed piston type swash plate variable displacement compressor. In such compressor, the discharge volume of the compressor per rotation of the drive shaft, or the displacement of the compressor, is large, as compared with a single-head piston type swash plate variable displacement compressor. The compressor may be made small in size for the displacement.

Second Embodiment

Figure 6:
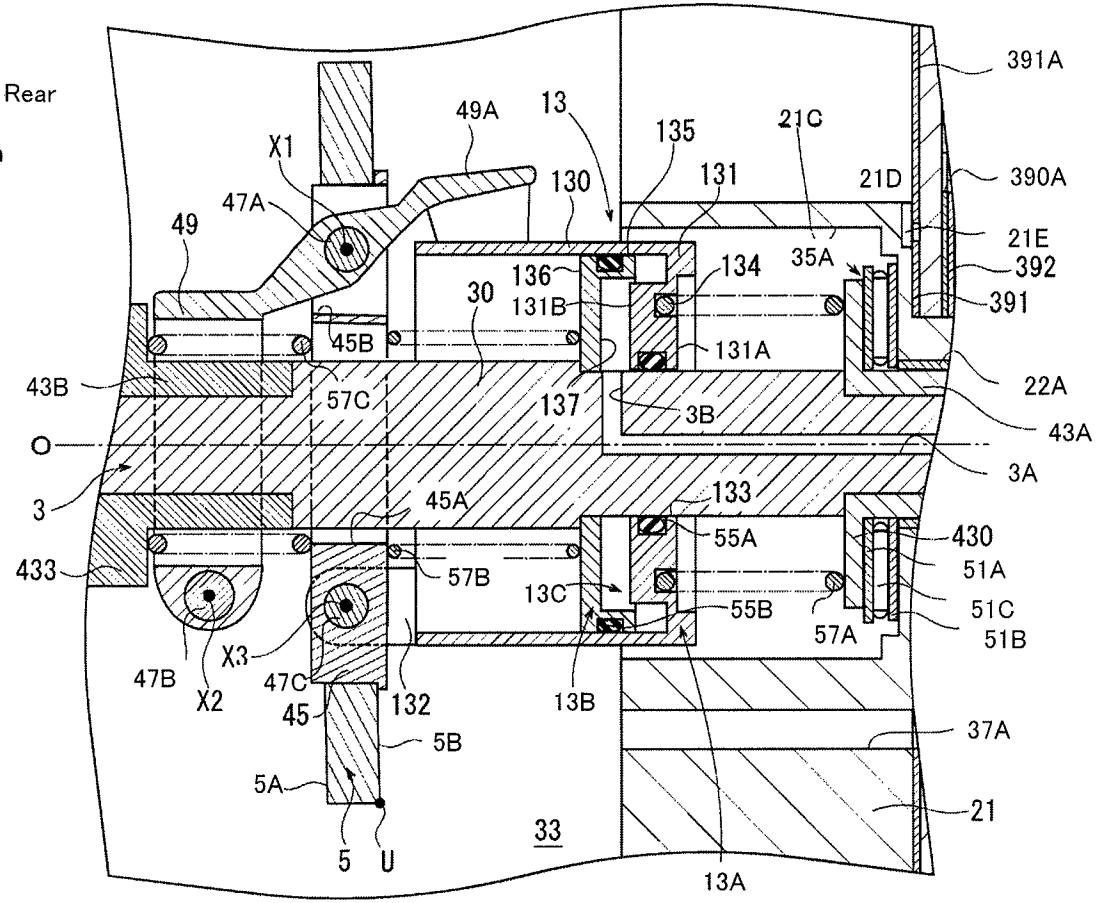
FIG. 6 is a partially enlarged fragmentary view of a compressor according to a second embodiment of the present invention, showing an actuator and a first coil spring.

The following will describe a compressor according to a second embodiment of the present inventing with reference to FIG. 6. The compressor of the second embodiment differs from that of the first embodiment in that the flange 430 of the first support member 43A is formed larger in the radial direction, as compared with the compressor of the first embodiment, so that the first coil spring 57A is disposed between the flange 430 and the groove 134 and, more specifically, the first coil spring 57A is provided between the first thrust bearing 35A and the moving body 13A in the first recess 21C. The rest of the configuration of the compressor according to the second embodiment is substantially the same as the first embodiment and, therefore, the description thereof will be omitted. In the description below, like reference numerals are used to designate like parts or elements of the first embodiment.

The first support member 43A is press-fitted on the drive shaft body 30, so that the first support member 43A and hence the flange 430 are rotatable with the drive shaft body 30. The disposition of the first coil spring 57A between the flange 430 and the groove 134 permits easy mounting of the first coil spring 57A between the first thrust bearing 35A and the moving body 13A in the first recess 21C. The compressor of the second embodiment provides the same effects as the first embodiment.

Third Embodiment

Figure 7:
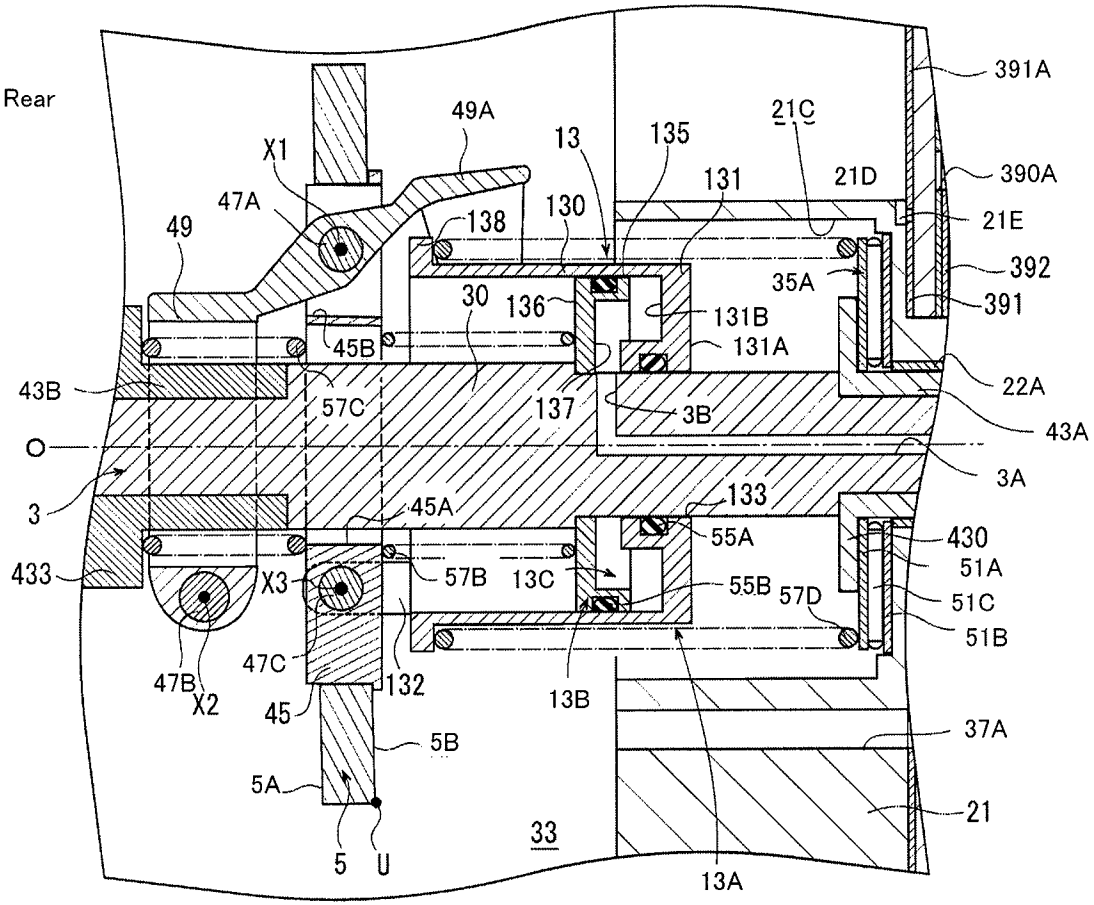
FIG. 7 is a partially enlarged fragmentary view of a compressor according to a third embodiment of the present invention, showing an actuator and a first coil spring.

The following will describe a compressor according to a third embodiment of the present invention with reference to FIG. 7. The third embodiment differs from the first embodiment in that the moving body 13A has at the front thereof an annular projection 138 formed extending from the peripheral wall 130 of the moving body 13A in a direction away from the drive shaft 3. The bottom wall 131 of the compressor of the third embodiment has a flat rear surface 131A having no groove such as 134. In addition, the moving body 13A and the partitioning body 13B have smaller inner diameters than the moving body of the compressor of the first embodiment and the arms 132 are made smaller, accordingly.

In the compressor of the third embodiment, the first coil spring 57A is replaced by a first coil spring 57D that extends in the direction of the axis O of the drive shaft 3 and is formed larger in length and diameter than the first coil spring 57A. The first coil spring 57D is disposed between the first thrust bearing 35A and the moving body 13A in the first recess 21C. More specifically, the first coil spring 57D is disposed between the first race 51A of the first thrust bearing 35A and the annular projection 138 of the peripheral wall 130 of the moving body 13A in the first recess 21C. The first coil spring 57D is contactable at the rear end thereof with the first race 51A and at the front end thereof with the annular projection 138. The first coil spring 57D urges the moving body 13A away from the first thrust bearing 35A. The first coil spring 57D corresponds to the urging member of the present invention.

In the compressor of the third embodiment, the first coil spring 57D is provided between the first race 51A and the annular projection 138, and the moving body 13A is disposed radially inward of the first coil spring 57D. The rest of the configuration of the compressor is substantially the same as the first embodiment.

In the compressor according to the third embodiment, the first coil spring 57D and the second coil spring 57B urges the swash plate 5 in the direction that reduces the inclination angle of the swash plate 5. The disposition of the first coil spring 57D between the first race 51A and the projection 138 secures a space for the first coil spring 57D in first recess 21C without increasing the size of the compressor. Therefore, the first coil spring 57D may be formed larger in length and diameter, as compared with the compressor of the first embodiment, and the swash plate 5 may be urged smoothly in the direction that reduces the inclination angle of the swash plate 5. In addition, the use of the first coil spring 57D having a large diameter helps to prevent the moving body 13A to be inclined during the movement in the direction of the axis O of the drive shaft 3.

Furthermore, the formation of the annular projection 138 extending radially from the peripheral wall 130 of the moving body 13A enables to reduce the weight of the moving body 13A by thinning the peripheral wall 130 and to increase the strength of the moving body 13A. The compressor according to the third embodiment offers substantially the same effects as the compressor of the first embodiment.

The present invention is not limited to the above described first, second and third embodiments, but it may be modified in various manners within the scope of the invention, as exemplified below.

The features of the second embodiment and the third embodiment may be combined in such a way that the first coil spring 57D is disposed between the flange 430 of the first support member 43A and the annular projection 138 of the moving body 13A.

The control mechanism 15 may be so configured that the control valve 15C is connected in the high pressure passage 15B and the orifice 15D is connected in the low pressure passage 15A, respectively. In such case, the control valve 15C controls the opening of the high pressure passage 15B. This enables the compressor to increase its displacement rapidly because the pressure of refrigerant in the first discharge chamber 29A can increase the pressure in the pressure control chamber 13C rapidly.

The present invention is applicable to an air conditioner.

What is claimed is:

1. A swash plate type variable displacement compressor comprising:

a housing having a suction chamber, a discharge chamber, a swash plate chamber and a plurality of cylinder bores;

a drive shaft rotatably supported in the housing;

a swash plate mounted on and rotatable with the drive shaft in the swash plate chamber;

a link mechanism provided between the drive shaft and the swash plate and permitting changing of an inclination angle of the swash plate relative to an imaginary plane extending perpendicularly to an axis of the drive shaft;

a plurality of pistons reciprocally movably received in the respective cylinder bores;

a conversion mechanism converting the rotation of the swash plate to reciprocal motion of the pistons with a stroke length that is determined in accordance with the inclination angle of the swash plate;

an actuator disposed in the swash plate chamber to change the inclination angle; and a control mechanism controlling the actuator;

wherein the actuator includes a partitioning body that is mounted on the drive shaft, a moving body that is movable along the axis of the drive shaft relative to the partitioning body, and a pressure control chamber that is formed between the partitioning body and moving body, wherein the actuator is configured in such a way that the moving body is moved when refrigerant in the discharge chamber is introduced into the pressure control chamber, wherein the link mechanism has a connecting member connected to the swash plate, wherein the moving body has a connecting unit connected to the swash plate, wherein the moving body is configured to move the swash plate toward the partitioning body via the connecting unit to increase the inclination angle when pressure in the pressure control chamber is increased, wherein the connecting member and the connecting unit are disposed on radially opposite sides of the axis of the drive shaft, wherein a thrust bearing is provided between the housing and the moving body, and wherein an urging member is provided between the thrust bearing and the moving body and urges the moving body in a direction that reduces the inclination angle of the swash plate.

2. The swash plate type variable displacement compressor according to claim 1, wherein a supplementary urging member is provided between the partitioning body and the swash plate and urges the swash plate in the direction that reduces the inclination angle.

3. The swash plate type variable displacement compressor according to claim 1, wherein the urging member is a coil spring that extends along the axis of the drive shaft, wherein the moving body includes a peripheral wall that extends along the axis of the drive shaft so as to surround the partitioning body and is slidable on the partitioning body and a bottom wall that extends from the peripheral wall towards the drive shaft and faces the thrust bearing, wherein the bottom wall has a groove recessed toward the partitioning body, and wherein the coil spring is disposed between the thrust bearing and the groove of the bottom wall.

4. The swash plate type variable displacement compressor according to claim 1, wherein the urging member is a coil spring that extends along the axis of the drive shaft, wherein the moving body includes a peripheral wall that extends along the axis of the drive shaft so as to surround the partitioning body and is slidable on the partitioning body and a bottom wall that extends from the peripheral wall towards the drive shaft, wherein an annular projection is formed extending from the peripheral wall in a direction away from the drive shaft, and wherein the coil spring is deposed between the thrust bearing and the annular projection.

5. The swash plate type variable displacement compressor according to claim 1, wherein the drive shaft has a flange with which the housing holds the thrust bearing, and wherein the urging member is disposed between the flange and the moving body.

6. The swash plate type variable displacement compressor according to claim 1, wherein the cylinder bores includes a plurality of pairs of cylinder bores each pair having a first cylinder bore and a second cylinder bore located at one end and the other end of the corresponding piston, respectively, wherein the piston has a first head portion that is movable in a reciprocating manner in the corresponding first cylinder bore and a second head portion that is movable in a reciprocating manner in the corresponding second cylinder bore, wherein the housing includes a first cylinder block in which the first cylinder bores are formed and a second cylinder block in which the second bores are formed, wherein the first cylinder block has a recess in which the moving body is received, wherein the recess of the first cylinder block forms a part of the swash plate chamber, and wherein the urging member is disposed in the recess.

* * * * *